US006991308B2

(12) United States Patent
Yamazaki

(10) Patent No.: US 6,991,308 B2
(45) Date of Patent: Jan. 31, 2006

(54) IMAGE FORMATION DEVICE, PROCESS CARTRIDGE INITIALIZING METHOD, AND PROCESS CARTRIDGE INITIALIZING PROGRAM

(75) Inventor: Hajime Yamazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/317,059

(22) Filed: Dec. 12, 2002

(65) Prior Publication Data

US 2003/0137578 A1 Jul. 24, 2003

(30) Foreign Application Priority Data

Dec. 12, 2001 (JP) ..... 2001-378228

(51) Int. Cl.
*B41J 29/38* (2006.01)

(52) U.S. Cl. ..... 347/5; 347/86; 347/140

(58) Field of Classification Search ..... 347/12, 347/140, 7, 5, 9, 19, 86; 399/81
See application file for complete search history.

(56) References Cited

U.S. PATENT DOCUMENTS

| | | | | |
|---|---|---|---|---|
| 5,220,386 | A * | 6/1993 | Aoki et al. | 399/71 |
| 5,491,506 | A | 2/1996 | Yagishita et al. | 347/246 |
| 5,508,729 | A | 4/1996 | Yamazaki | 347/247 |
| 5,710,956 | A * | 1/1998 | Kurohata et al. | 399/24 |
| 5,797,690 | A * | 8/1998 | Iwamura et al. | 400/124.01 |

FOREIGN PATENT DOCUMENTS

| | | |
|---|---|---|
| JP | 9-185236 | 7/1997 |
| JP | 2000-258979 | 9/2000 |

* cited by examiner

*Primary Examiner*—Hai Pham
*Assistant Examiner*—Lam Nguyen
(74) *Attorney, Agent, or Firm*—Oblon, Spivak, McClelland, Maier & Neustadt, P.C.

(57) ABSTRACT

When a new process cartridge is detected, that new process cartridge is initialized. A flag that indicates initialization status of the new process cartridge is set and stored. When a new process cartridge is detected, the flag is set to indicate non-initialization, the flag is maintained in that status during the initialization of the new process cartridge is being performed by the initialization unit, and the flag is set to indicate initialization completion when the initialization of the process cartridge is completed normally.

9 Claims, 6 Drawing Sheets

IMAGE FORMATION DEVICE, PROCESS CARTRIDGE INITIALIZING METHOD, AND PROCESS CARTRIDGE INITIALIZING PROGRAM

BACKGROUND OF THE INVENTION

1) Field of the Invention

The present invention relates to initialization of new process cartridge.

2) Description of the Related Art

When an image formation device such as a copier is shipped, a process cartridge that includes a photosensitive member and a developing section is put in a separate carton to avoid contamination inside the image formation device. The process cartridge is installed into the copier body at the destination. When the copier body is booted, a new cartridge detecting unit automatically detects the new process cartridge, and, initialization, including developer agitation, toner filling, and image formation voltage and writing output adjustments, is performed. As a result, optimum processing conditions are set to obtain desired image quality beginning from the very first copy. This type of process cartridge has been disclosed in, for example, Japanese Patent Application Laid-Open No. 2000-258979 (hereinafter "patent publication 1"). Japanese Patent Application Laid-Open No. 9-185236 (hereinafter "patent publication 2") discloses an image formation device that checks a history that indicates whether the installed toner cartridge is a new one or a used one. The device initializes the history when a new cartridge is installed and executes an image forming operation under a pre-determined running condition. On the other hand, if a used toner cartridge is installed, the device does not initialize the history.

In general, the configuration for detecting whether the process cartridge is new is a mechanical one associated with the process cartridge and the copier body. However, if the new cartridge detecting unit is faulty and does not properly detect installation of the new process cartridge, then printing may be started without execution of the initialization of the cartridge. In this case, apart from the drawback that a desired image quality can not be obtained, the process cartridge, which is almost new, has to be replaced with another new process cartridge. This problem arises if the mechanism for mechanically detecting a new process cartridge is employed. This problem also arises in the image formation device disclosed in the patent publication 2 that executes initialization of the process cartridge based on the history.

Moreover, when a user opens a door, or an unexpected sudden power failure occurs during the initialization of the copier body and the process cartridge, it interrupts the initialization and causes the normal printing to start before completion of the initialization. Since the initialization is incomplete; a desired image is not obtained.

SUMMARY OF THE INVENTION

According to the present invention, when a new process cartridge is detected, that new process cartridge is initialized. Moreover, a flag that indicates initialization status of the new process cartridge is set and stored. When a new process cartridge is detected, the flag is set to indicate non-initialization, the flag is maintained in that status during the initialization of the new process cartridge is being performed by the initialization unit, and the flag is set to indicate initialization completion when the initialization of the process cartridge is completed normally.

Alternately, the flag is to indicate non-initialization before detection of the new process cartridge, initialization of the process cartridge is started when the process cartridge is detected and the power is turned on. When the new process cartridge is detected, the flag is set to indicate non-initialization, the flag is maintained in that status during the initialization of the new process cartridge is being performed by the initialization unit, and the flag is set to indicate initialization completion when the initialization of the process cartridge is completed normally.

These and other objects, features and advantages of the present invention are specifically set forth in or will become apparent from the following detailed descriptions of the invention when read in conjunction with the accompanying drawings.

DETAILED DESCRIPTIONS

Exemplary embodiments of the present invention are explained below with reference to the accompanying drawings though these embodiments are not intended to limit the invention.

Figure 1:
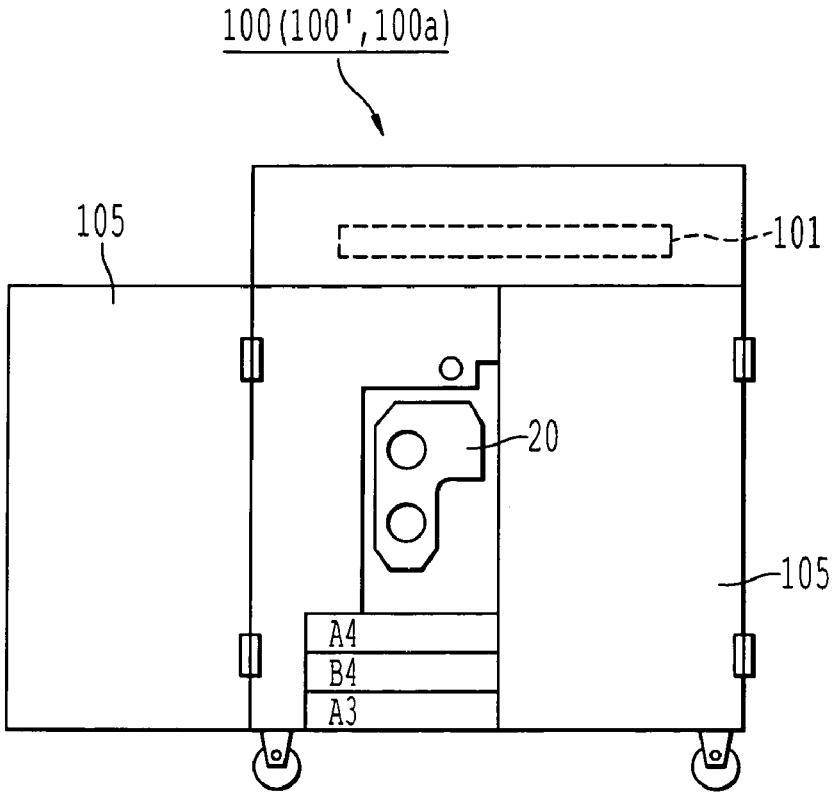
FIG. 1 schematically shows a configuration of the image formation device according to a first embodiment of the present invention.
Figure 2:
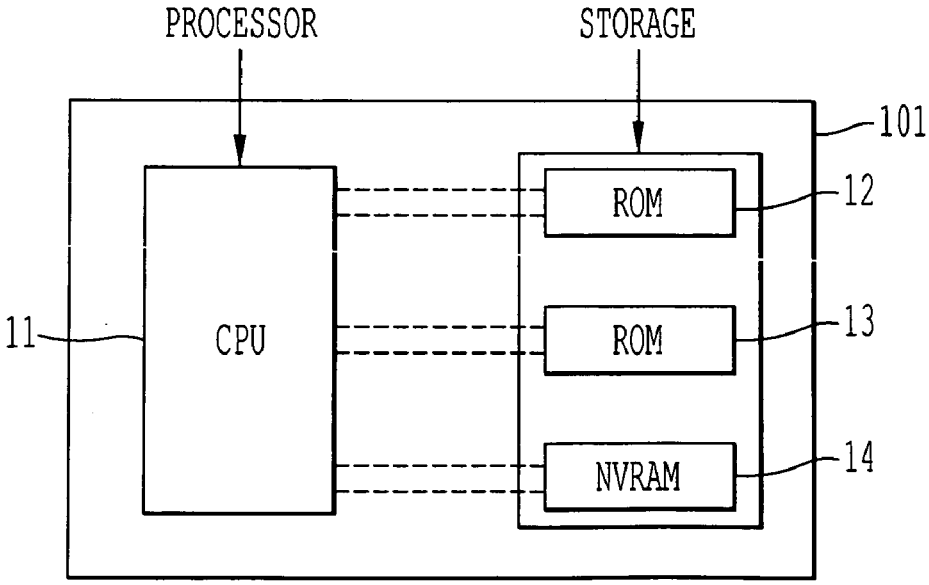
FIG. 2 shows a base engine board contained in the image formation device according to the first embodiment.

FIG. 1 schematically shows an arrangement of the image formation device according to a first embodiment of the present invention. FIG. 2 shows a base engine board contained in the image formation device according to the first embodiment. The image formation device 100 according to the first embodiment includes an initialization flag setting section that sets an initialization flag ON when initialization of a process cartridge is executed, and sets the initialization flag OFF when the initialization is normally completed. Thus, when the initialization flag is ON it means that the initialization has not been performed at all or not been completed, and when the initialization flag is OFF it means that the initialization has been performed and completed.

The image formation device 100 comprises of a base engine board 101. As shown in FIG. 2, the base engine board 101 includes, as major constituent thereof, a central processing unit (hereinafter, "CPU") 11 as an information processor, and a read only memory (hereinafter "ROM") 12, a random access memory (hereinafter "RAM") 13, and a non-volatile read only memory (hereinafter "NVRAM") 14. The ROM 12, the RAM, and the NVRAM function as means for storing information.

The CPU 11 controls the image formation device 100. The ROM 12 stores the process cartridge initializing program according to the present invention. The RAM 13 temporarily stores print data and other data. The NVRAM 14 serves as the initialization flag setting section and an initialization history storage described later.

The information storage may include a read-only memory such as a hard disc, a magneto-optic disc and a compact disc read only memory (hereinafter "CD-ROM"), or a combination thereof, or a combination of the above with the ROM 12 or with the RAM 13. Alternatively, the information storage may be realized from specifically designed hardware. The image formation device 100 may be connected to peripherals such as input devices and displays (not depicted), if required, to improve the function of the image formation device 100. The input devices include a keyboard and a mouse. The displays include a cathode ray tube (hereinafter "CRT") and a liquid crystal display (hereinafter "LCD"), for example.

The process cartridge initializing method according to the present invention may be achieved when a previously prepared process cartridge initializing program is executed by a computer, such as a personal computer and a work station, connected to the image formation device 100 to control the image formation device 100. The process cartridge initializing program can be distributed via networks, for example, the Internet. The process cartridge initializing program may be recorded in a computer-readable record medium such as a hard disc, a flexible disc (hereinafter "FD"), a CD-ROM, a magneto-optical disc (hereinafter "MO"), and a digital versatile disc (hereinafter "DVD"), and it is read out of the record medium by the computer to control the image formation device 100. The process cartridge initializing program may be written into the ROM 12 and the NVRAM 14 by directly accessing them from an external device.

Figure 3A:
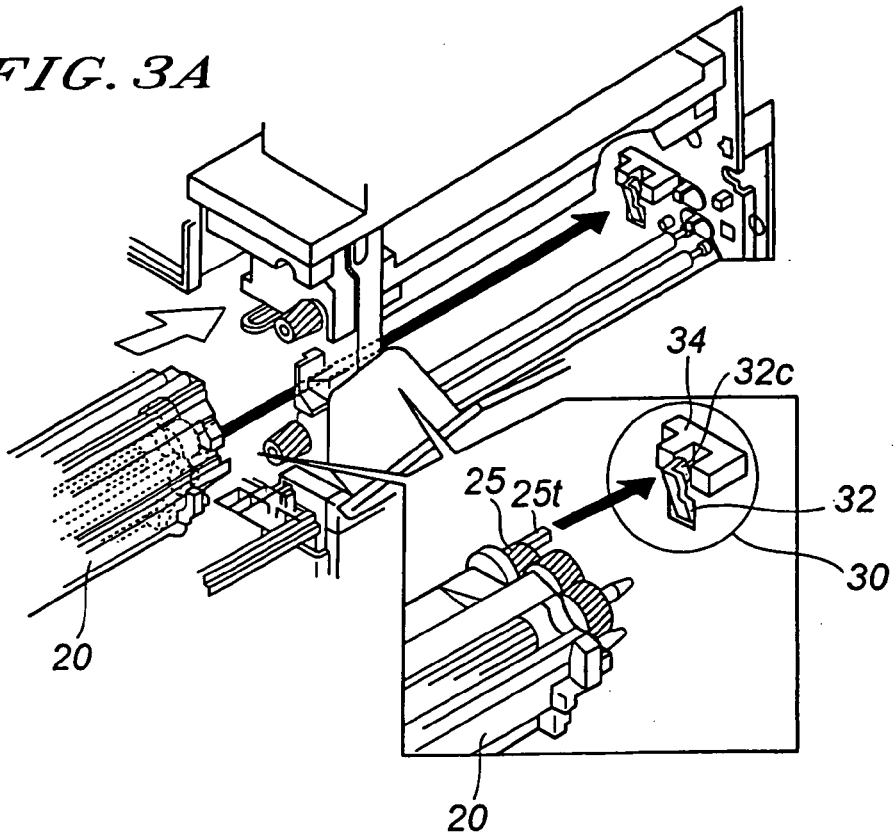
FIG. 3A and FIG. 3B are views that show a mechanism for detecting a process cartridge in the image formation device according to the present invention.
Figure 3B:
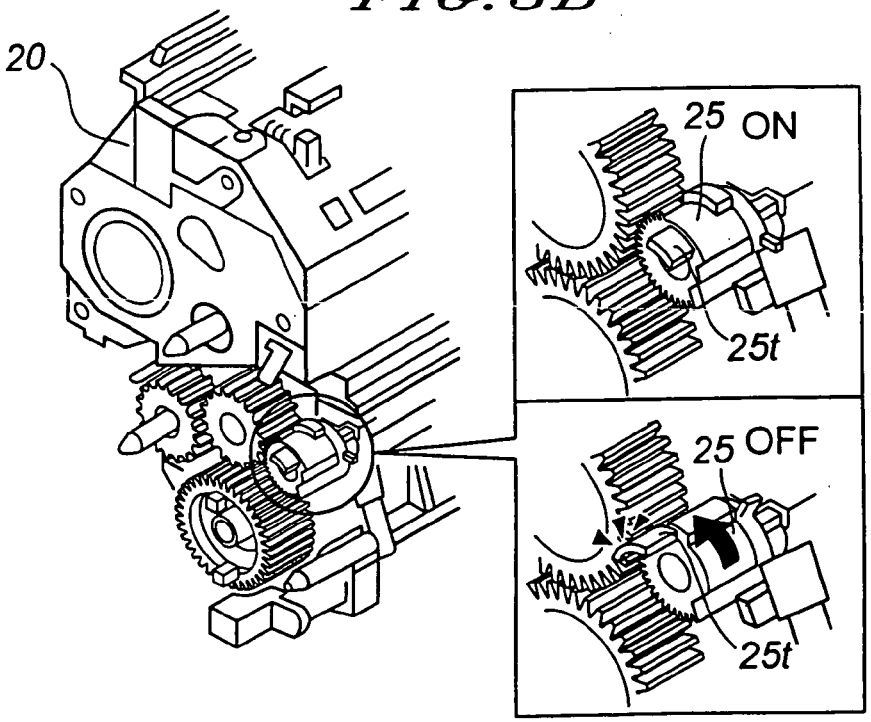

FIG. 3A and FIG. 3B are views that show a mechanism for detecting a process cartridge in the image formation device according to the present invention. A process cartridge 20 is provided with a gear cam 25 that functions as a new cartridge detecting unit at the process cartridge side. When the new process cartridge 20 is set in the image formation device 100, a protrusion 25*t* formed on the gear cam 25 presses a filler 32.

The image formation device 100 comprises of a new process cartridge detecting unit 30 of the image formation device (enclosed within a solid-line circle in FIG. 3A). The new process cartridge detecting unit 30 includes the filler 32 and a new product sensor 34. The filler 32 has a pawl 32*c*, which can access the new product sensor 34. The new product sensor 34 employs an optical sensor, for example, to detect the filler 32 based on the coming and going of the pawl 32*c*.

As shown in FIG. 3A, when the new process cartridge 20 is attached to the image formation device 100, the protrusion 25*t* formed on the gear cam 25 presses the filler 32. Then, the pawl 32*c* of the filler 32 is pressed against the new product sensor 34, which detects the pawl 32*c* and sends the information to the CPU 11. Thus, the CPU 11 recognizes that the new process cartridge 20 is attached to the image formation device 100.

When the new process cartridge 20 is detected, the corresponding initialization is started. As the initialization progresses, the gear cam 25 simultaneously rotates as shown in FIG. 3B to take the protrusion 25*t* off the location of the filler 32. Subsequently, the pawl 32*c* of the filler 32 is taken off the new product sensor 34, which sends the information to the CPU 11. Based on the information, the CPU 11 recognizes that the use of the attached process cartridge 20 is started.

Figure 4:
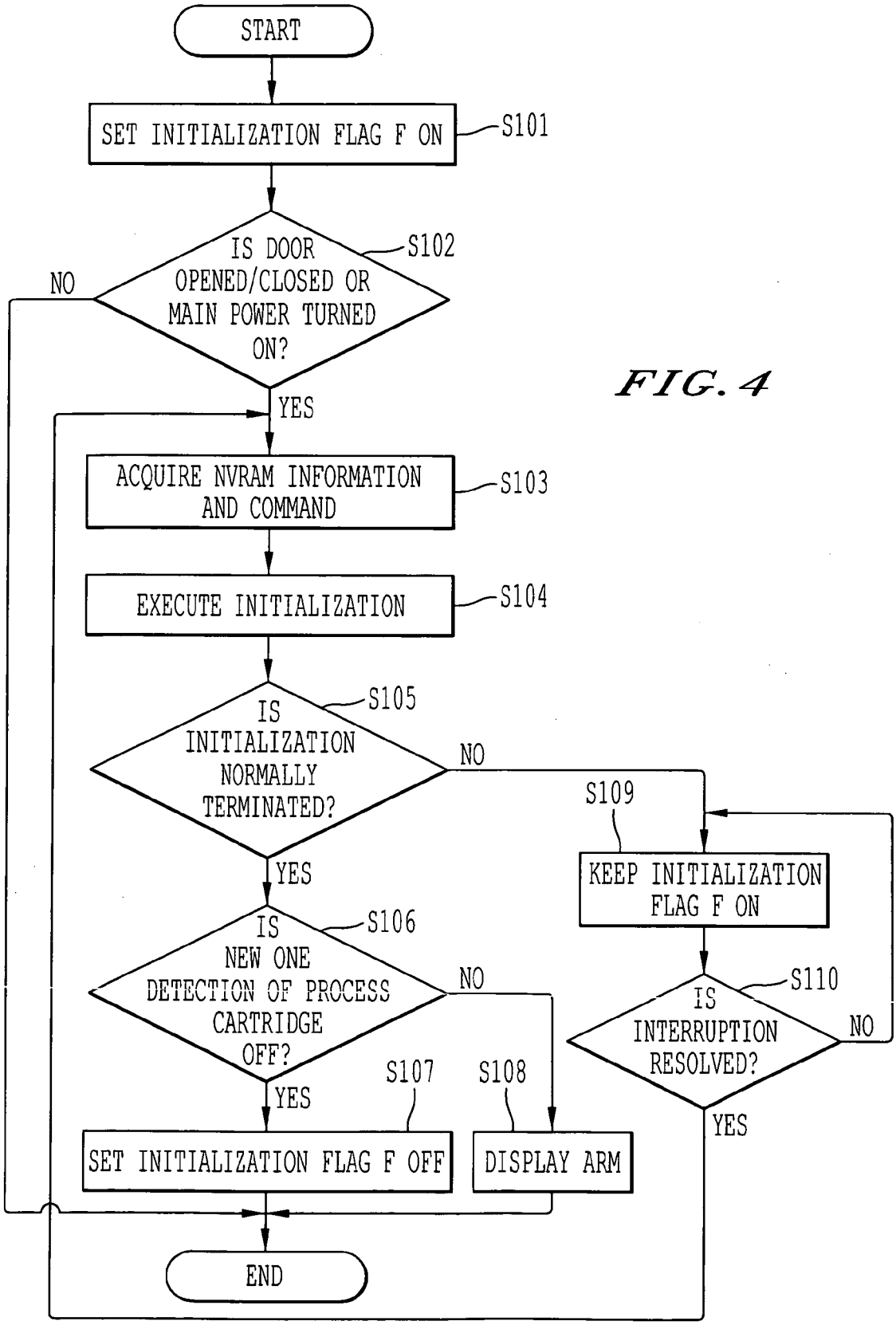
FIG. 4 is a flowchart that explains one example of the various steps performed during initialization of the image formation device according to the first embodiment.

FIG. 4 is a flowchart that explains one example of the various steps performed during initialization of the image formation device according to the first embodiment. With reference to this figure, a process cartridge initializing method according to the first embodiment of the invention is explained. When the device is shipped from the factory or before the new process cartridge 20 is set, the initialization flag F is set ON in the initialization flag setting section, i.e., in the NVRAM 14, (step S101). In the image formation device 100 according to the invention, the initialization flag F is held ON until the later-explained initialization of the process cartridge 20 is normally terminated. Through the use of software, the initialization flag F is set ON. For convenience of processing on the CPU 11, the initialization flag F may be handled with "1" for ON and "0" for OFF.

When the factory-shipped image formation device 100 is employed, it is installed at the site for use. Then, the new process cartridge 20 is attached to the image formation device 100. It is determined next if the main power to the image formation device 100 is turned on or a door 105 is opened/closed (step S102). If yes for either, the CPU 11 mounted on the base engine board 101 in the image formation device 100 acquires the information from the NVRAM 14 (step S103). If the main power is turned on when the new process cartridge 20 is not attached to the image formation device 100, the initialization of the process cartridge 20 is not started.

The initialization flag F stored in the NVRAM 14 has been set ON previously before the image formation device 100 is shipped. The CPU 11 issues a command that instructs the process section, including the driver of the process cartridge 20, to execute the initialization of the process cartridge 20. On receipt of this command, the process section is driven to execute the initialization such as developer agitation along with supplying toner into the developer and toner filling (step S104).

The initialization includes agitation of toner and developer, and the toner is supplied to the developer until the toner concentration is adjusted appropriately. A toner sensor is employed to sense the toner concentration. It is determined next if the initialization is normally terminated (step S105). If normally terminated, then it is determined next if the process cartridge 20 is new (step S106). As shown in FIGS. 3A and 3B, as the initialization of the process cartridge 20 progresses, the protrusion 25*t* of the gear cam 25 provided on the process cartridge 20 is taken off the location of the filler 32 in the image formation device 100. As a result, the new one detection of the process cartridge 20 exhibits OFF (step S106: Yes). If the new one detection of the process cartridge 20 is OFF, it means that the initialization is normally terminated. Therefore, the initialization flag F is set OFF and stored in the NVRAM 14 (step S107). Thus, the initialization of the process cartridge 20 after installation of the image formation device 100 is terminated.

If the protrusion 25*t* can not take off the location of the filler 32 due to the failure of the gear cam 25, for example, the new one detection of the process cartridge 20 remains ON (step S106: No). In this case, the control enters the same routine through the door open/close (step S102), and displays an alarm in a monitor screen on the image formation device 100 (step S108) to instruct a repair by the serviceman. If the operator turns off the main power or opens the door 105 during the routine, the initialization is interrupted. Even in this case, as the initialization flag F, which is set ON at the beginning of the routine (step S101), is still kept unchanged, the initialization can be restarted after the interruption is resolved.

During the initialization of the process cartridge 20, when the power to the image formation device 100 is broken or the door 105 is opened due to the power failure or the operator's error, the initialization is interrupted. When the protrusion 25*t* formed on the gear cam 25 of the process cartridge 20 is faulty and the new process cartridge detecting unit 30 at the image formation device 100 can not detect the protrusion 25*t*, the initialization can not be started even though the process cartridge 20 is normally attached. Thus, when the initialization is interrupted or not started, it can not be determined that the initialization is normally terminated. In the image formation device 100 according to the present invention, the initialization flag F is configured to keep ON until the initialization of the process cartridge 20 is normally terminated. Therefore, unless the initialization of the process cartridge 20 is normally terminated (step S105: No), the initialization flag F is kept ON unchanged (step S109).

It is determined next if the interruption of the initialization is resolved (step S110), and if the interruption of the initialization is resolved, the CPU 11 reads information out of the NVRAM 14 (step S103). The initialization flag F stored in the NVRAM 14 in this moment is still held ON, so the CPU 11 issues a command for instructing the initialization of the process cartridge 20 to be executed.

In the image formation device 100 according to the present invention with such the arrangement, even though the initialization of the new process cartridge 20 after installation is interrupted due to some cause, the initialization can be restarted. As a result, the initialization of the new process cartridge 20 at the time of installation can be executed reliably and desired image quality can be obtained from when the use of the new image formation device 100 is started. In addition, even when the protrusion 25*t* formed on the gear cam 25 has a component defect, the initialization of the new process cartridge 20 at the time of installation can be executed reliably and desired image quality can be obtained from when the use of the new image formation device 100 is started.

It is also possible to access the NVRAM 14 from external to write the initialization flag F therein. In this way, the initialization flag F can be set ON when the image formation device 100 is shipped from the factory. The process cartridge 20 is set in the image formation device 100 after it arrives at the site. The protrusion 25*t* formed on the gear cam 25 of the process cartridge 20 may have a component defect, which can not be detected by the image formation device 100. Even in such a situation, the initialization can be executed reliably and printing can be started in an optimal image formation process state.

After the new image formation device 100 arrives, then the new process cartridge 20 is attached thereto, and the initialization is normally terminated, the initialization flag F can be written into the NVRAM 14 if it is accessible from external. Thus, the initialization flag F is still kept ON even when a second new process cartridge 20 is attached. Therefore, initialization of the new process cartridge 20 can also be executed reliably.

When it is detected by the new process cartridge detecting unit 30 in the image formation device 100 that the new process cartridge 20 is attached to the image formation device 100 (between the steps S102 and S103 in FIG. 4), the initialization flag F in the NVRAM 14 may also be set ON. In this case, the CPU 11 detects the initialization flag F being set ON, and start the initialization of the process cartridge 20. As a result, even when the process cartridge 20 is replaced to a new one two or more times after the image formation device 100 is installed, the initialization of the process cartridge 20 can be completed reliably.

Figure 5:
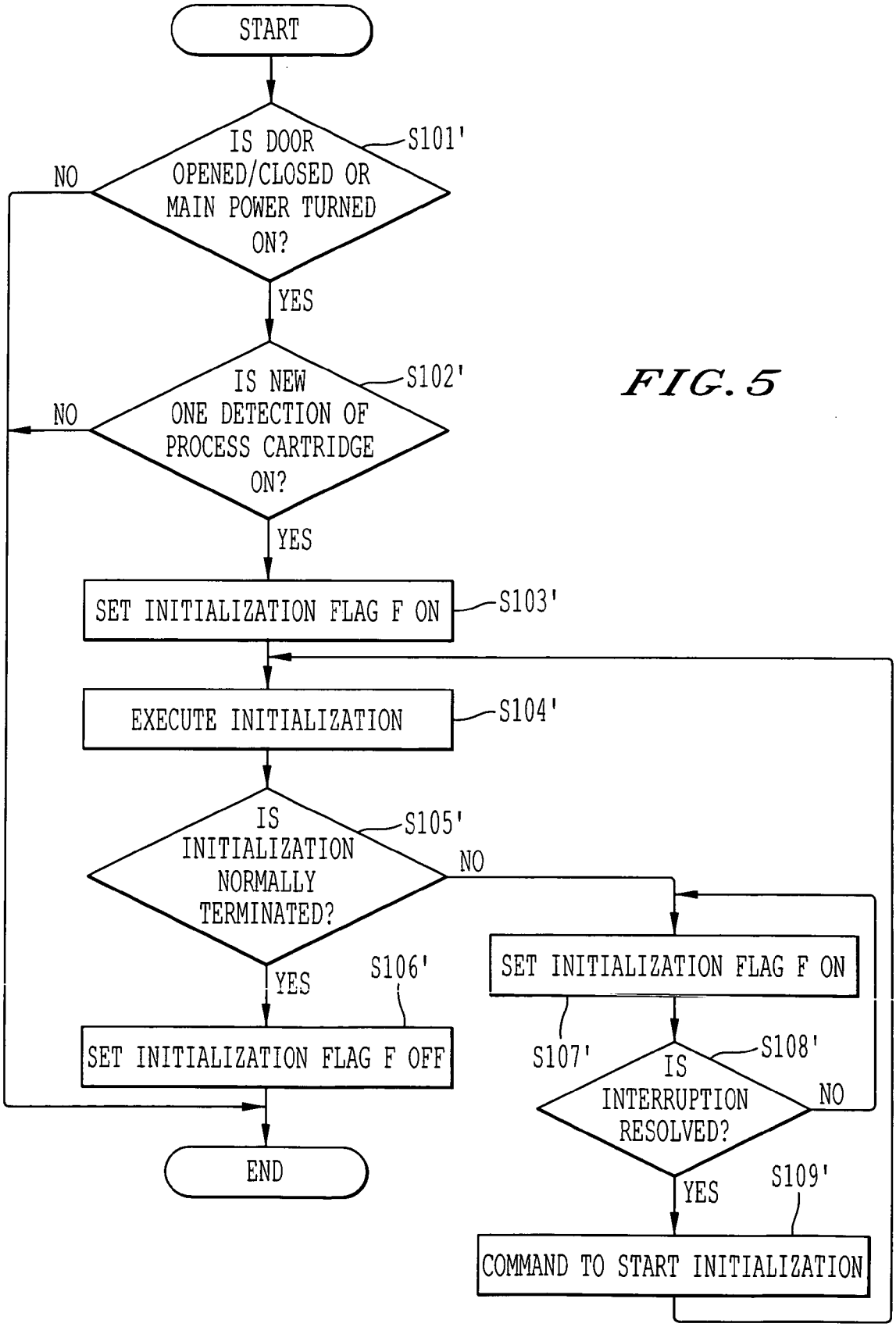
FIG. 5 is a flowchart that explains another example of the various steps performed during initialization of the image formation device according to the first embodiment.

FIG. 5 is a flowchart that shows initialization of the image formation device according to an alternative of the first embodiment. The image formation device 100' sets the initialization flag F in the NVRAM 14 to ON after the power is turned on or the door 105 is opened/closed and when the new process cartridge detecting unit 30 in the image formation device 100' detects the process cartridge 20.

When the factory-shipped image formation device 100' is employed, it is installed at the site for use. Then, the new process cartridge 20 is attached to the image formation device 100'. It is determined next if the main power to the image formation device 100' is turned on or the door 105 is opened/closed (step S101'). If yes for either, the control goes to the next step S102'. When the new process cartridge detecting unit 30 in the image formation device 100' detects the new process cartridge 20 (step S102': Yes), a detection signal is fed into the CPU 11 mounted on the base engine board 101. Subsequently, the CPU 11 sets the initialization flag F in the NVRAM 14 to ON (step S103').

On receipt of the command issued from the CPU 11, the process section in the process cartridge 20 executes the initialization including developer agitation along with supplying toner into the developer, for example (step S104'). The toner is supplied into the developer until the toner concentration is adjusted appropriately, and the initialization is terminated. If the initialization is terminated normally (step S105': Yes), the initialization flag F is set OFF and stored in the NVRAM 14 (step S106'), and the initialization of the process cartridge 20 after the installation of the image formation device 100' is terminated. Unless the initialization of the process cartridge 20 is terminated normally, the initialization flag F is kept OFF unchanged (step S107').

During the initialization of the process cartridge 20, when the power to the image formation device 100' is broken due to the power failure, for example, or the door 105 of the image formation device 100' is opened, the initialization is interrupted. In the present invention, when the initialization is interrupted, it is determined that the initialization of the process cartridge 20 is not normally terminated, and the initialization flag F is kept ON unchanged. When the interruption is resolved (step S108'), the CPU 11 reads the initialization flag F again from the NVRAM 14 and issues a command to execute the initialization of the process cartridge 20 (step S109'). Thus, the initialization can be restarted after the interruption of the initialization is resolved.

In the image formation device 100' according to the present invention with such the arrangement, even though the initialization of the new process cartridge 20 after installation is interrupted due to some cause, the initialization is restarted. In addition, the initialization of the new process cartridge 20 at the time of installation can be executed reliably and desired image quality can be obtained from when the use of the new image formation device 100 is started.

Figure 6:
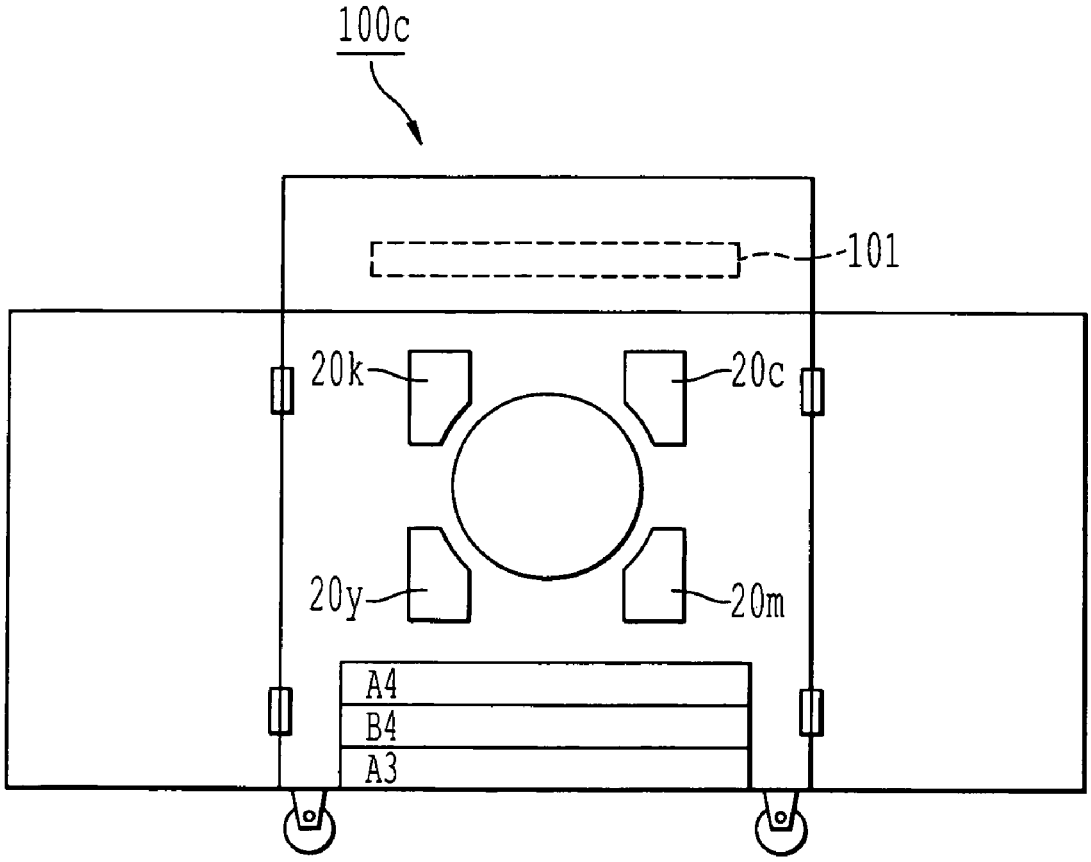
FIG. 6 shows an outline of a color image formation device.

The present invention is applicable not only to monochromic image formation devices but also to color image formation devices. FIG. 6 shows an outline of a color image formation device. As shown, the color image formation device such as a color copier and a color printer generally requires a total of four process cartridges 20*c*, 20*m*, 20*y*, 20*k* of C (Cyan), M (Magenta), Y (Yellow), K (Black).

An initialization flag F is previously set ON in the NVRAM 14 mounted on the base engine board 101 provided in a color image formation device 100*c*. As described above, the initialization flag F is kept ON until initializations of the process cartridges 20*c*–20*k* are normally completed. As a result, even when the initialization of a new process cartridge is interrupted, the initialization can be restarted so as to execute the initialization at the time of installation of the new process cartridge 20. In addition, desired image quality can be obtained from when the use of the new image formation device 100*c* is started.

The four process cartridges 20*c*–20*k* may be initialized simultaneously or sequentially. When they are initialized simultaneously, a single initialization flag F is employed and, when the initialization is interrupted, it should be restarted preferably for all the process cartridges 20*c*–20*k* from the beginning.

When the four process cartridges 20*c*–20*k* are initialized sequentially, four initialization flags Fc, Fm, Fy, Fk are prepared corresponding to the four process cartridges 20*c*–20*k* to manage the initializations of the process cartridges 20*c*–20*k* individually. When the initialization of the process cartridge 20*c*–20*k* is normally terminated, the corresponding initialization flag is set OFF. Therefore, only the process cartridge, not completely initialized normally, can be subjected to restart. As a result, when the initialization is restarted, initialization of the process cartridge once initialized normally is not required and thus the initialization can be completed efficiently.

The image formation devices according to the first embodiment and the alternative thereof are explained above. The arrangement of the present invention herein explained can be also applied suitably to the following embodiment.

Figure 7:
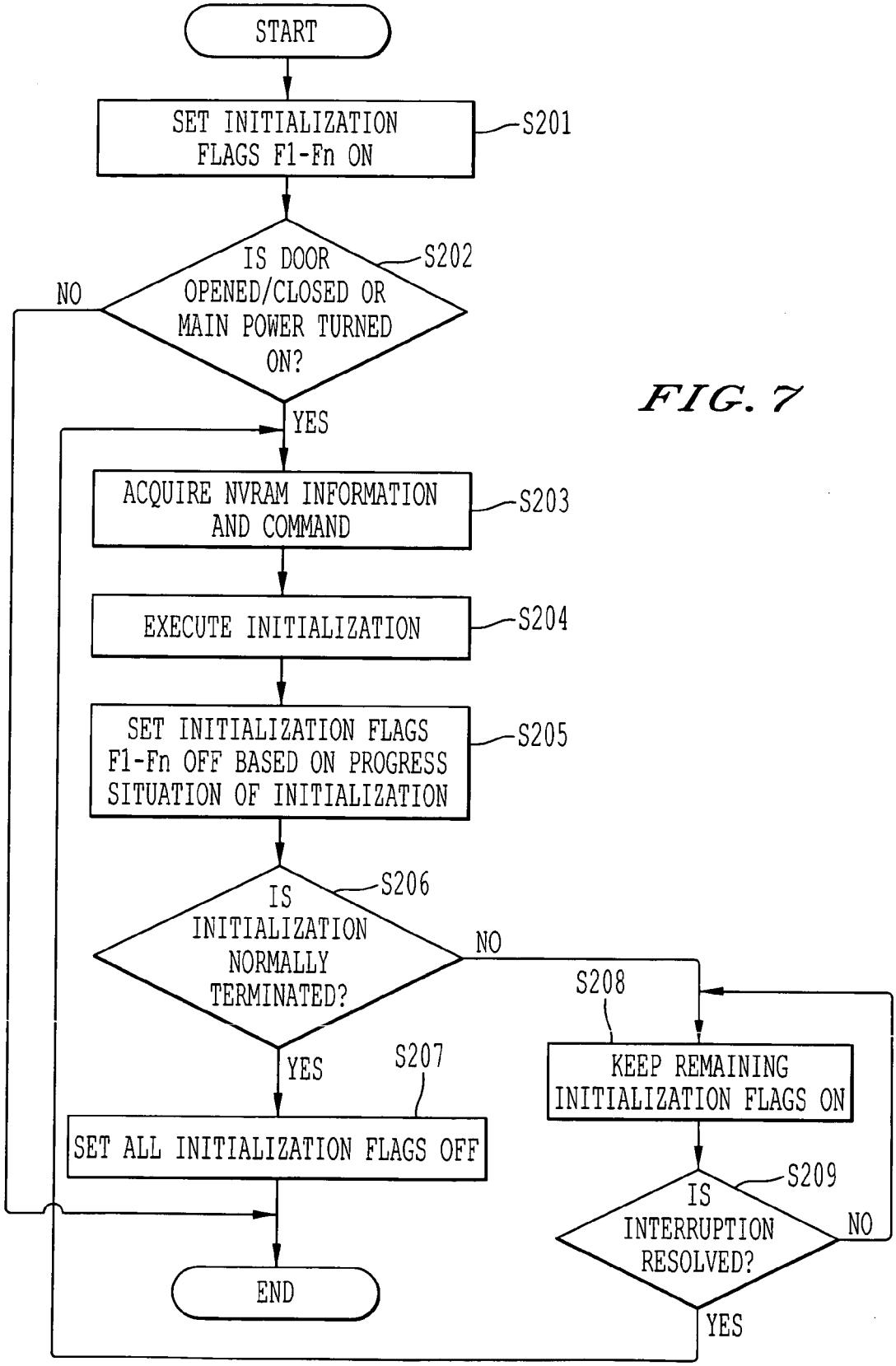
FIG. 7 is a flowchart that explains one example of the various steps performed during initialization of the image formation device according to a second embodiment of the present invention.

FIG. 7 is a flowchart that explains one example of the various steps performed during initialization of the image formation device according to a second embodiment of the present invention. The image formation device 100*a* is configured substantially same as the image formation device 100 according to the first embodiment except for holding a progress history of the initialization of the process cartridge in initialization history storage. In this case, based on the progress history, the initialization can be restarted from a location where the initialization is interrupted. Other arrangements are same as those in the first embodiment and accordingly the same reference numerals are given to the same constituents. The image formation device 100*a* is configured substantially same as the image formation device 100, 100' according to the first embodiment (see FIG. 1) and its explanation is herein omitted.

The NVRAM 14 mounted on the base engine board 101 (see FIGS. 1 and 2) in the image the forming device 100*a* is also employed as the initialization history storage. After shipment from the factory or before a new process cartridge 20 is attached, a plurality of initialization flags F1–Fn are set ON previously in the NVRAM 14 (step S201). In the image the forming device 100*a* according to the present invention, based on the progress situation of the initialization of the process cartridge 20, among the initialization flags F1–Fn, a certain number of those are set OFF and the remains are kept ON. Because the initialization flag is either ON or OFF, the progress situation of the initialization can be determined based on the number of initialization flags being set ON. Alternatively, individually identifiable initialization flags, corresponding to respective operations contained in an initialization, may be stored in the NVRAM 14 previously. An example of the latter includes the use of flag codes: (0001) for representing an agitating step; and (0010) for a voltage setting step, for example.

When the factory-shipped image formation device 100*a* is employed, it is installed at the site for use. Then, the new process cartridge 20 is attached to the image formation device 100*a*. It is determined next if the main power to the image formation device 100 is turned on or the door 105 is opened/closed (step S202). If yes for either, the CPU 11 mounted on the base engine board 101 in the image formation device 100*a* reads the information from the NVRAM 14 (step S203).

The initialization flags F1–Fn stored in the NVRAM 14 have been all set ON previously before the image formation device 100*a* is shipped. The CPU 11 issues a command that instructs the process section, including the driver of the process cartridge 20, to execute the initialization of the process cartridge 20 (the same step S203). On receipt of this command, the process section is driven to execute the initialization such as developer agitation along with supplying toner into the developer, for example (step S204).

Based on the progress situation of the initialization of the process cartridge 20, the initialization flags F1–Fn stored in the NVRAM 14 are set OFF (step S205). When the initializations are normally terminated (step S206: Yes), the initialization flags F1–Fn are all set OFF (step S207). When the initialization flag is represented by the code information, the flag code corresponding to each initialization flag is reset to (0000) when the initialization is terminated.

If the power to the image formation device 100*a* is broken due to the power failure or the operator's error, for example, the initialization of the process cartridge 20 is interrupted. In the image formation device 100*a* according to the present invention, based on the progress situation of the initialization of the process cartridge 20, some of the initialization flags F1–Fn are set OFF and the remains are kept ON unchanged (step S208). Therefore, when the interruption is resolved (step S209: Yes), the CPU 11 acquires information on the initialization flags in ON state stored in the NVRAM 14 (step S203) and determines the progress situation of the initialization based on the number of the flags.

Thus, the initialization can be restarted from the location where it is interrupted. As a result, initialization of a new process cartridge 20 at the time of installation can be executed reliably and the initialization is not required to restart from the beginning. This is effective to reduce a time period required for initialization after interruption. The arrangement of the present invention according to the second embodiment is also applicable to the alternative explained in the first embodiment, needless to say.

As explained above, in the image formation device according to the first aspect of the invention, an initialization flag that indicates execution of initialization is set in a non-initialized state after a new process cartridge is attached to the image formation device or during the initialization of the process cartridge. Thus, even when the initialization is interrupted when the power is failed or the door of the image formation device is opened/closed, the initialization can be executed reliably at the time of attachment of or after replacement to the new process cartridge to prevent the image quality from degrading.

The image formation device according to the second aspect of the invention includes the initialization flag setting section capable of arbitrarily setting the initialization flag. Thus, even when the initialization is interrupted when the power is failed or the door of the image formation device is opened/closed, the initialization can be executed reliably at the time of attachment of or after replacement to the new process cartridge to prevent the image quality from degrading.

In the image formation device according to the third aspect of the invention, the initialization flag is set in the non-initialized state previously before the new process cartridge is attached. The initialization flag is kept in the non-initialized state until the initialization of the process cartridge is normally terminated. Thus, when the process cartridge is incorporated into the image formation device on arrival to execute the initialization, even when the new cartridge detecting unit at the process cartridge is abnormal, the initialization after replacement of the process cartridge can be executed reliably. In addition, even when the initialization is interrupted when the power is failed or the door of the image formation device is opened/closed, the initialization can be executed reliably at the time of attachment of or after replacement to the new process cartridge to prevent the image quality from degrading.

In the image formation device according to the fourth aspect of the invention, after the new image formation device is shipped, and when the process cartridge is replaced to a second or later new one, the initialization flag is set in the non-initialized state and stored in the initialization flag setting section. Thus, when the process cartridge is replaced to a second or later new one after the new the image formation device is shipped, even when the initialization is interrupted, the initialization of the new process cartridge can be executed. This is effective to prevent the image quality from degrading.

The image formation device according to the fifth aspect of the invention comprises of the initialization history storage to store a progress history of the initialization and, based on the progress history of the initialization, the initialization is restarted from a location where the initialization is interrupted. Thus, it is not required to start the initialization from the beginning at the time of restart of the initialization. This is effective to reduce a time period required for the initialization after interruption.

The progress cartridge initializing method according to the sixth aspect of the invention comprises of the step of setting the initialization flag, which indicates execution of the initialization, in the non-initialized state after a new process cartridge is attached to the image formation device or during initialization of the process cartridge. Thus, even when the initialization is interrupted when the power is failed or the door of the image formation device is opened/closed, the initialization can be executed reliably at the time of attachment of or after replacement to the new process cartridge to prevent the image quality from degrading. The progress cartridge initializing method can be achieved using a progress cartridge initializing program that runs on a computer to execute the progress cartridge initializing method.

The progress cartridge initializing method according to the seventh aspect of the invention comprises of the steps of setting the initialization flag in the non-initialized state previously before the new progress cartridge is attached, and holding the initialization flag in the non-initialized state until the initialization of the progress cartridge is normally terminated. Thus, when the process cartridge is incorporated into the image formation device on arrival to execute the initialization, even when the new cartridge detecting unit at the process cartridge is abnormal, the initialization after replacement of the process cartridge can be executed reliably. In addition, even when the initialization is interrupted when the power is failed or the door of the image formation device is opened/closed, the initialization can be executed reliably at the time of attachment of or after replacement to the new process cartridge to prevent the image quality from degrading. The progress cartridge initializing method can be achieved using a progress cartridge initializing program that runs on a computer to execute the progress cartridge initializing method.

In the progress cartridge initializing method according to the eighth aspect of the invention, a progress history of the initialization of the initialization is stored and, based on the progress history, the initialization is restarted from a location where the initialization is interrupted. Thus, it is not required to start the initialization from the beginning at the time of restart of the initialization. This is effective to reduce a time period required for the initialization after interruption. The progress cartridge initializing method can be achieved using a progress cartridge initializing program that runs on a computer to execute the progress cartridge initializing method.

The present document incorporates by reference the entire contents of Japanese priority document, 2001-378228 filed in Japan on Dec. 12, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation device, comprising:

a new process cartridge detecting unit that detects when a new process cartridge is set;

an initialization unit that performs an initialization of the set new process cartridge when the new process cartridge detecting unit detects the new process cartridge;

an initialization flag storage that stores an initialization flag that indicates an initialization stats of the new process cartridge;

an initialization flag setting unit that controls and sets the initialization flag in the initialization flag storing unit; and a new product determination unit that counts a total number of times the new process cartridge detecting unit detects the new process cartridge plus next new process cartridges, wherein when a count in the new product determination unit is equal to zero, the initialization flag indicates non-initialization of the new process cartridge, and wherein when the count in the new product determination unit is equal to or greater than one, the initialization flag setting unit sets the initialization flag to indicate non-initialization when the new process cartridge detecting unit has detected the new process cartridge, maintains the initialization flag to indicate non-initialization when the initialization of the new process cartridge is being performed by the initialization unit, and sets the initialization flag to indicate initialization completion when the initialization of the new process cartridge has been completed normally by the initialization unit.

2. An image formation device, comprising:

a new process cartridge detecting unit that detects when a new process cartridge is set;

an initialization unit that performs an initialization of the set new process cartridge when the new process cartridge detecting unit detects the new process cartridge;

an initialization flag storing unit that stores an initialization flag that indicates an initialization status of the new process cartridge;

an initialization flag setting unit that controls and sets the initialization flag in the initialization flag storing unit; and a power unit that supplies power to the image formation device, wherein the initialization flag setting unit sets the initialization flag to indicate non-initialization before the new process cartridge detecting unit detects the new process cartridge, wherein the initialization unit starts initialization of the set new process cartridge when the new process cartridge detecting unit detects the new process cartridge and the power unit is turned on, wherein the initialization flag setting unit maintains the initialization flag to indicate non-initialization when the initialization of the new process cartridge is being performed by the initialization unit, and sets the initialization flag to indicate initialization completion when the initialization of the new process cartridge has been completed normally by the initialization unit, and wherein, via external instructions, the initialization flag setting unit is instructed to reset the initialization flag to indicate non-initialization, during a time period extending from after the initialization flag setting unit sets the initialization flag to indicate initialization completion of the new process cartridge until before the new process cartridge detecting unit detects a next new process cartridge.

3. The image formation device according to claim 2, wherein the external instructions are input by a user of the image formation device.

4. A process cartridge initializing method, realized on an image formation device, comprising the steps of:

turning on a power supply of the image formation device;

detecting setting of a new process cartridge;

performing an initialization of the set new process cartridge;

setting and storing an initialization flag that indicates an initialization status of the new process cartridge, the setting and storing step including, setting the initialization flag to indicate non-initialization before the new process cartridge detecting unit detects the new process cartridge, starting the initialization of the new process cartridge when the new process cartridge is detected, maintaining the initialization flag to indicate non-initialization when the initialization of the new process cartridge is being performed by the initialization unit, setting the initialization flag to indicate initialization completion when the initialization of the new process cartridge has been completed normally by the initialization unit; and resetting, via external instructions, the initialization flag to indicate non-initialization, during a time period extending from after the setting of the initialization flag to indicate initialization completion of the new process cartridge until before detecting of a next new process cartridge.

5. The image formation device according to claim 4, wherein the external instructions are input by a user of the image formation device.

6. An image formation device, comprising:

a new process cartridge detecting unit that detects when a new process cartridge is set;

an initialization unit that performs an initialization of the set new process cartridge when the new process cartridge detecting unit detects the new process cartridge;

an initialization flag storing unit that stores an initialization flag that indicates an initialization status of the new process cartridge; and an initialization flag setting unit that controls and sets the initialization flag in the initialization flag storing unit, wherein the initialization flag setting unit sets the initialization flag to indicate non-initialization before the new process cartridge detecting unit detects the new process cartridge is set, wherein the initialization unit starts initialization of the set new process cartridge when the new process cartridge detecting unit detects the new process cartridge, wherein the initialization flag setting unit maintains the initialization flag to indicate non-initialization when the initialization of the new process cartridge is being performed by the initialization unit, and sets the initialization flag to indicate initialization completion when the initialization of the new process cartridge has been completed normally by the initialization unit, and wherein, via external instructions, the initialization flag setting unit is instructed to reset the initialization flag to indicate non-initialization, during a time period extending from after the initialization flag setting unit sets the initialization flag to indicate initialization completion of the new process cartridge until before the new process cartridge detecting unit detects a next new process cartridge.

7. The image formation device according to claim 6, wherein the external instructions are input by a user of the image formation device.

8. A method of detecting and initializing a new process cartridge of an image formation device, comprising:

storing an initialization flag that indicates an initialization status of the new process cartridge;

setting the initialization flag to indicate non-initialization before the new process cartridge is detected is set;

detecting when the new process cartridge is set;

starting initialization of the set new process cartridge when the new process cartridge is detected;

maintaining the initialization flag to indicate non-initialization when the initialization of the new process cartridge is being performed and setting the initialization flag to indicate initialization completion when the initialization of the new process cartridge has been completed normally; and resetting, via external instructions, the initialization flag to indicate non-initialization, during a time period extending from after the setting of the initialization flag to indicate initialization completion of the new process cartridge until before detecting of a next new process cartridge.

9. The image formation device according to claim 8, wherein the external instructions are input by a user of the image formation device.

* * * * *